FIP8110 XR 3,953,675

United States Patent [19]

Babb

[11] 3,953,675

[45] Apr. 27, 1976

[54] AUDIO SPEAKER SYSTEM

[75] Inventor: Burton A. Babb, Dallas, Tex.

[73] Assignee: Babbco, Ltd., Dallas, Tex.

[22] Filed: May 8, 1972

[21] Appl. No.: 250,899

[52] U.S. Cl. ..... 179/1 E; 181/148; 181/198

[51] Int. Cl.[2] ..... H04R 1/02; G10K 11/00

[58] Field of Search ..... 179/1 E; 181/31 B, 33 G, 181/33 C, 33 D, 33 L

[56] References Cited

UNITED STATES PATENTS

| | | | |
|---|---|---|---|
| 1,975,201 | 10/1934 | Elworthy | 181/31 B |
| 2,994,399 | 8/1961 | Zimmerman et al. | 181/31 B |
| 3,233,695 | 2/1966 | Hutchins | 181/31 B |
| 3,240,289 | 3/1966 | Kanesuke Kishi | 181/31 B |
| 3,593,819 | 7/1971 | Giraudeau | 181/33 G |

*Primary Examiner*—Douglas W. Olms
*Attorney, Agent, or Firm*—Hubbard, Thurman, Turner & Tucker

[57] ABSTRACT

A sealed speaker enclosure formed from a loud speaker and five square shaped walls. Each wall forming the enclosure is constructed from a thin sheet of acoustically transmitting material and a plurality of perpendicularly intersecting ribs. These intersecting ribs are attached together at their intersections to form a rigid interconnecting rib structure. The rib structure extends across and is attached to one side of the sheet so that the ribs extend transverse to one side of the sheet. The walls are attached together at their edges to form a five sided enclosure. The rib structures of adjacent walls are in contact and attached together to add rigidity to the walls. The loud speaker is attached to the walls to form a sixth side of the enclosure.

10 Claims, 7 Drawing Figures

AUDIO SPEAKER SYSTEM

BACKGROUND OF THE INVENTION

The present invention relates to an apparatus for producing audible sounds, and more particularly to an improved speaker enclosure with walls which are lightweight and which inefficiently radiate low frequency acoustical energy from the enclosure while more efficiently radiating higher frequency acoustical energy.

DESCRIPTION OF THE PRIOR ART

In the field of producing acoustical energy in the audio frequency range (20 to 20,000 hz) from loud speakers, it has been the general practice to employ loud speakers which radiate acoustical energy from both the front and rear of the speaker cone. In order to prevent low frequency acoustical energy radiated from the rear of the speaker from interfering with and distorting the acoustical energy transmitted from the front of the speaker, it has been customary to enclose a volume of air with an enclosure made of sufficiently heavy panels to block these frequencies. These mass controlled enclosures operate on the principal that the walls are so heavy that the rear radiated low frequency acoustical energy cannot accelerate the walls to a sufficient extent to transmit the acoustic energy. Since it is essential that the volume of air within the enclosure be sufficiently great to keep the back pressure on the loud speaker below a desired operational maximum, the external dimensions of the enclosure must be increased substantially due to the increased wall thickness necessary to provide the required mass. In addition, the massive wall structure adds to the weight of the enclosure itself making it difficult, if not impossible, to support such an enclosure from an ordinary wall shelf or the like.

An additional problem which has been found to exist in these mass controlled systems is that the volume of air within the enclosure will tend to resonate at a given frequency. If radiated acoustical energy of the resonant frequency is trapped within the enclosure, as in a mass controlled speaker system, distortion of the output of the speaker system will result. To solve this problem it has been proposed to add materials to the interior of the speaker enclosure which absorb the rear radiated acoustical energy in the range of the resonant frequency of the enclosure, thus eliminating the resonance problems. Although the addition of acoustic absorption material within the enclosure damps the undesired resonances, it tends to have the undesirable effect of detracting from performance at non-resonant frequencies by reducing the efficiency of the system. This distraction and loss of efficiency is due to the fact that sound created within the speaker enclosure by rear radiation of the speaker would otherwise in some cases be reflected back through the cone of the speaker, and become forwardly radiated sound. Thus, the acoustic energy radiated forward of the cone of the speaker will be reduced in intensity at all audio frequencies, because the damping material absorbs energy at all audio frequencies.

SUMMARY OF THE INVENTION

The general purpose of the present invention is to provide an improved speaker enclosure with walls which significantly eliminate acoustical interference by reducing transmission of low frequency acoustic energy through the walls of the enclosure, yet which eliminates the necessity of thick massive walls. To attain this result, the present invention contemplates the use of an improved enclosure having edge supported walls which have sufficient stiffness to inefficiently transmit low frequency acoustic energy therethrough. While stiff walls are used to block low frequency energy, the mass of the wall is made low enough to allow for adequate transmission through the walls of other frequencies of the rear radiated acoustical energy, including acoustical energy around the resonant frequencies of the enclosure. This transmission eliminates the resonance problems of the enclosure so that the enclosure no longer needs to be lined with sound absorbing material.

OBJECTS OF THE INVENTION

An object of the present invention is the provision of an improved speaker enclosure.

Another object of the present invention is to provide an improved speaker enclosure which reduces acoustical interference.

A further object of the present invention is the provision of an improved speaker enclosure which has an improved efficiency at higher frequencies.

Still another object of the present invention is the provision of an improved speaker enclosure which reduces the resonance of the speaker enclosure.

Yet another object of the present invention is the provision of an improved speaker enclosure with an inclined front face which allows for easy direction of the front radiated acoustical energy from the enclosure.

A still further object of the present invention is the provision of an improved speaker enclosure which, for a given required internal air volume, is lightweight and compact in size.

Another object of the present invention is the provision of an improved speaker enclosure which is simple and inexpensive to manufacture and assemble.

Other objects and many of the attendant advantages of the invention will be readily appreciated by those of ordinary skill in the art as the same becomes better understood by reference to the following detailed description when considered in connection with the accompanying drawings in which:

DESCRIPTION

Figure 1:
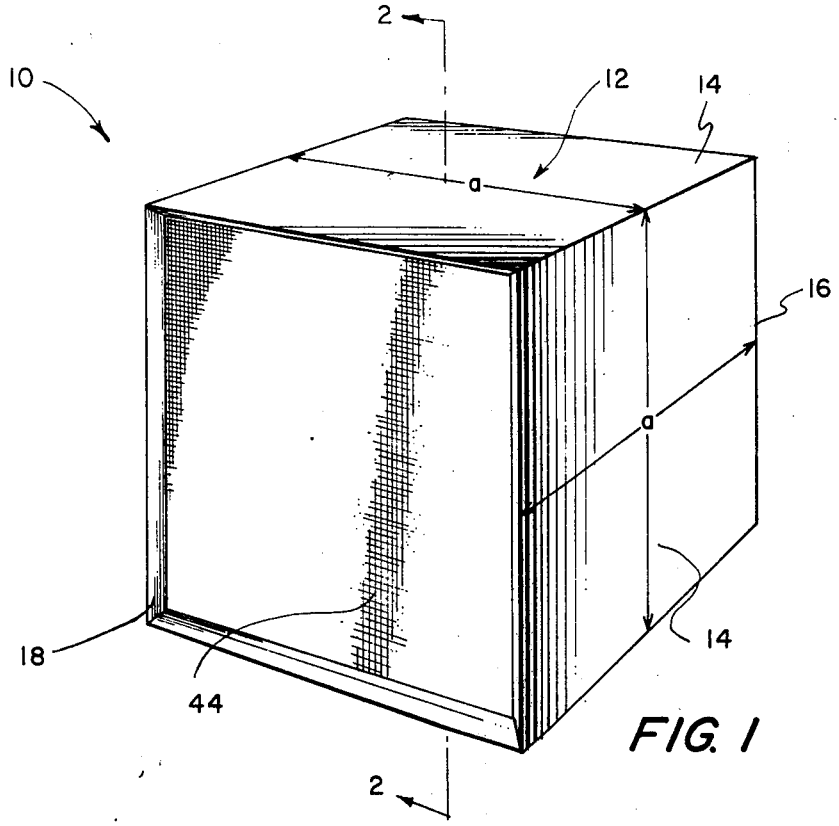
FIG. 1 is a perspective view of the improved speaker enclosure of the present invention.
Figure 2:
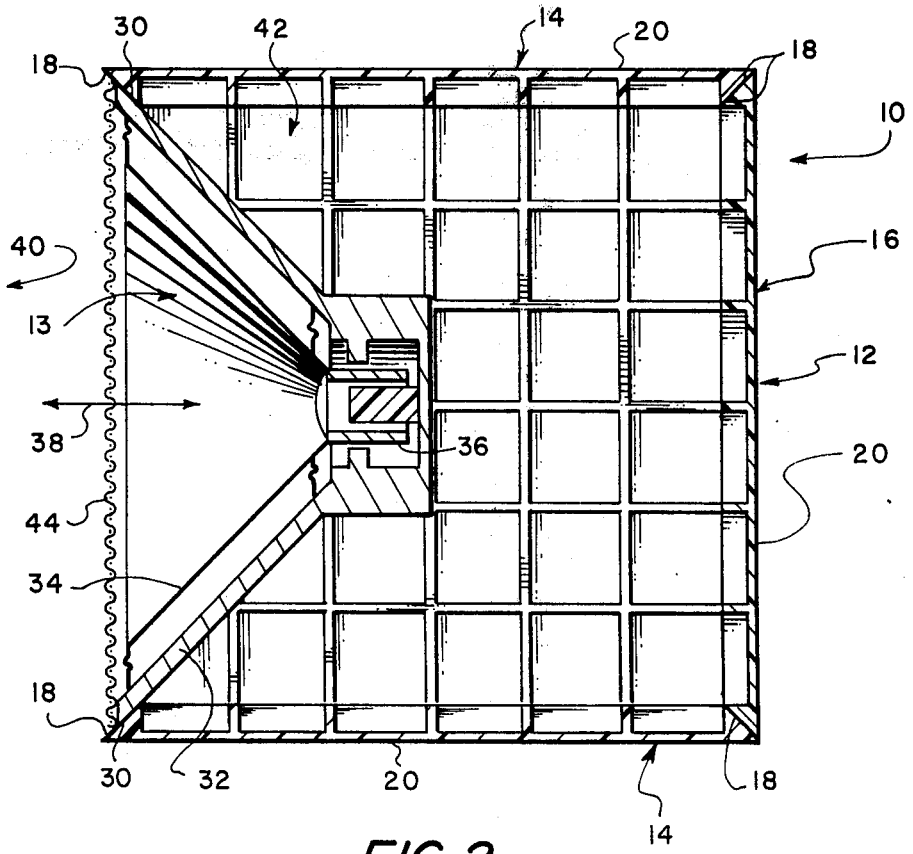
FIG. 2 illustrates a section of the enclosure taken on the line 2—2 of FIG. 1, looking in the direction of the arrows showing the interior of the speaker enclosure itself.

Referring now to the drawings, wherein like reference characters designate like or corresponding parts throughout the several views, there is shown in FIGS. 1 and 2 a sealed acoustic suspension speaker system which is designated by reference numeral 10. For purposes of this application, a sealed acoustic suspension speaker system comprises an acoustic energy transducer and a sealed enclosure 12 which surrounds the rear of the transducer, enclosing a compressible volume of air. In the present embodiment, the transducer is illustrated as a conventional loudspeaker 13 and the enclosure as being a hollow cube. This cube has identical width, height, and depth dimensions which are referenced by the letter "*a*". It is envisioned, of course, that other types of transducers and shapes of enclosures could be used.

The enclosure 12 is formed from four square side walls 14 and a square rear wall 16 which are joined together at their adjacent edges by the 45° bevelled surfaces 18. In one embodiment of the invention these walls were of styrene material and were attached together by applying an adhesive mixture of 20% styrene and 80% of either toluene or methylene chloride to the surfaces 18.

Figure 3:
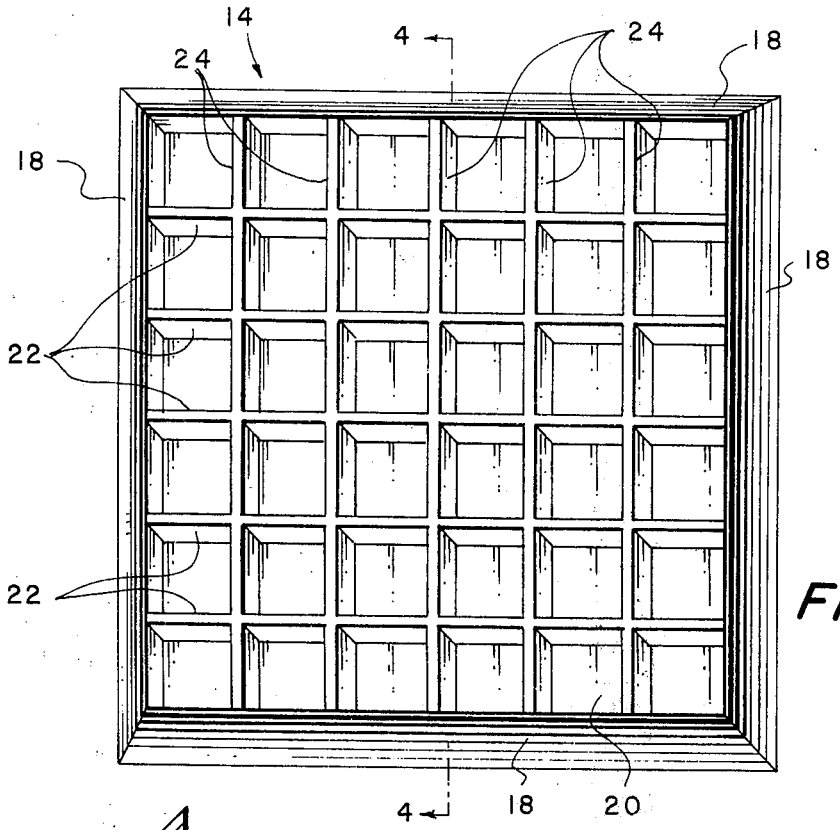
FIG. 3 is a perspective view of one wall of the speaker enclosure illustrated in FIG. 1.
Figure 4:
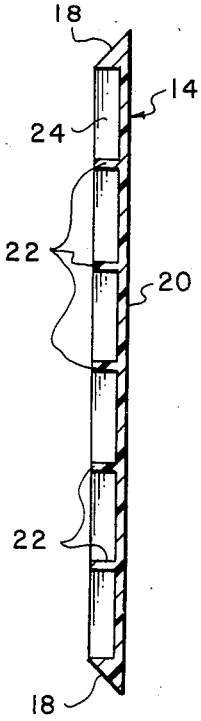
FIG. 4 illustrates a section of the wall taken on line 4—4 of FIG. 3, looking in the direction of the arrows.

For purposes of understanding the detail structure of the walls of the enclosure of the present invention, side wall 14 has been shown in detail in FIGS. 3 and 4. It is to be noted that in the present embodiment the four side walls 14 and rear wall 16 are identical in size, shape and construction. The wall 14 has 45° bevelled surfaces 18 on its edges for use in attaching the walls together as previously described. The wall 14 is constructed from a thin diaphragm 20 and a plurality of integral ribs extending transverse thereto. In the embodiment shown, five ribs 22 extend completely across the walls and a second group of five ribs 24 extend transverse to the ribs 22 and completely across the walls, as shown. In this manner, the walls are constructed with a low density, yet are relatively rigid to resist deflection of the wall in a direction normal to the plane of the wall itself.

Figure 5:
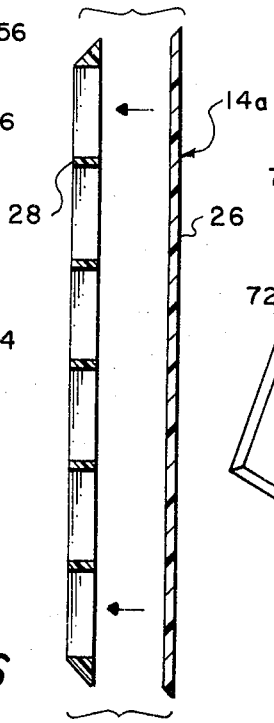
FIG. 5 is a view similar to FIG. 4 illustrating an alternate embodiment of the wall structure.

An alternate embodiment 14*a* of the wall structure is shown in FIG. 5 as being assembled from a thin sheet of material 26 which is attached to a separate rib structure 28 by means of a suitable adhesive. It is to be noted that by assembling the enclosure in this manner the materials forming the sheet 26 can differ in stiffness and density from the material forming the rib structure 28, thus enabling the designer to alter the acoustical characteristics of the wall.

A conventional loudspeaker 13 is shown attached to the exposed bevelled surfaces 18 of the side walls 14 by means of mating surfaces 30 on the frame 32 of the speaker 13. It is anticipated that the surfaces 30 could be attached to the walls by means of a suitable adhesive or fasteners, as desired. The speaker 13 is of the type which is well known in the art and is presently commercially available. The speaker 13 has a cone shaped acoustical energy generating element 34 which is operatively associated with and driven by an electromagnetic coil 36, so that when the coil 36 is actuated by an electrical signal the element 34 will reciprocate in the direction of the arrows 38 to radiate acoustical waves from the front 40 of the speaker 13 and from the rear 42 of the speaker 13 into the enclosure 12. For purposes of simplicity of description, the system 10 is illustrated as having only one speaker 13. However, more than one speaker can be used, if desired. The speaker 13 is mounted so that the front radiated acoustical energy is radiated through a speaker grill cloth 44 and out of the system 10, while the rear radiated acoustical energy is radiated into the interior of the sealed enclosure 12. This grill cloth 44 is of the type normally used for covering the front opening of a speaker enclosure.

In operation, the speaker 13 of this system 10 will generate both front and rear radiated acoustical energy in the audio spectrum. While the front radiated energy will be transmitted fully from the system 10, the rear radiated energy must first pass through the walls of the enclosure 12 before escaping the system 10. Each of the walls 14 and 16 has been constructed as described with a stiffness or resistance to normal deflection sufficient to inefficiently transmit low frequency energy therethrough. Because of this stiffness, rear radiated low frequency energy will be retained in the enclosure 12 and will not be efficiently transmitted therefrom, thus reducing acoustical interference. The walls are also each provided with low mass density areas or cavities between the ribs to allow the walls to efficiently radiate frequencies other than low frequency. In this manner, the transmission characteristics of the walls tend to complement the speaker response.

Figure 6:
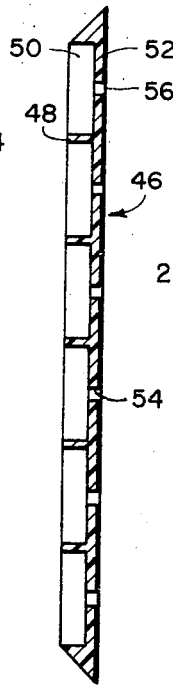
FIG. 6 is a view similar to FIG. 4 illustrating another embodiment of the wall structure.

A third embodiment of the wall is shown in FIG. 6 and identified by reference numeral 46. This wall 46, in some respects, is identical to the wall 14 with ribs 48 and 50 and diaphragm 52 corresponding to the ribs 22 and 24 and diaphragm 20 of the wall 14. The wall 46 differs in that a plurality of bores 54 are formed in the diaphragm 52. A thin web 56 is attached to the diaphragm 52 on the side opposite the ribs to cover the bores 54. The web 56 is formed from thin material to allow for transmission of high frequency acoustic energy therethrough. By making the web 46 as thin as possible, the mass of the web will not substantially hinder the transmission of high frequency acoustic energy therethrough.

In the illustrated embodiment, the wall 46 is attached to and covers the entire diaphragm 52. However, it is envisioned, of course, that the web 56 could be attached to cover only the bores 54 and the area of the diaphragm 52 adjacent the bores 54. It is also to be noted that the thickness of the web 56 will be limited due to the necessity that the exterior of the speaker system be able to prevent puncture or damage during use.

In one embodiment the external dimensions of the walls of the enclosure were 6½ inches by 6½ inches and a 5½ inch diameter speaker was used. The walls were constructed from styrene and the ribs and web were 0.040 inch thick. The ribs were 0.50 inch deep and were spaced 0.56 inch apart. It was determined that the volume of the enclosure should resonate in the area of 1000 to 2000 hz, but due to the transmission characteristics of the walls at this frequency, resonance was prevented.

Figure 7:
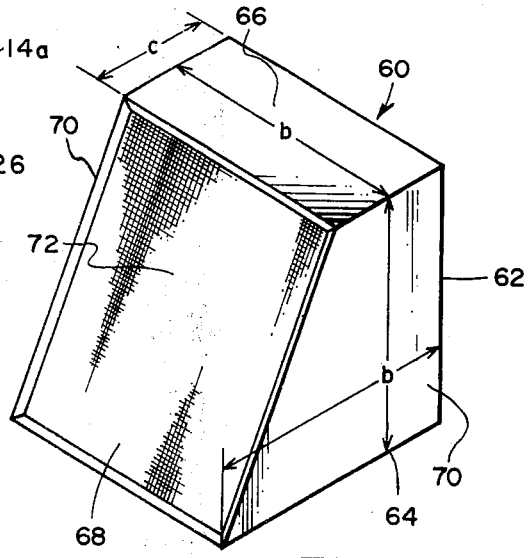
FIG. 7 is a perspective view of another embodiment of the speaker enclosure of the present invention.

In FIG. 7 an alternative embodiment 60 of the speaker enclosure of the present invention is shown with the speaker mounted at an angle of 20° to the rear wall 62. The rear wall 62 and bottom wall 64 are square shaped and have an external dimension of "*b*". The top wall 66 is rectangular shaped and has a width dimension of "*b*". The length of the wall 66 is dimension "c" which is shorter than dimension "b" due to the inclination of the front wall 68. The side walls 70 are trapezoid shaped.

It is to be noted that the exterior of all of the walls 64, 66, and 70 are finished so that the enclosure 60 can be placed on a flat surface resting on any of the walls to direct energy from the speaker grill 72, as desired.

It should be understood, of course, that the foregoing disclosure relates to only preferred embodiments of the invention and that numerous modifications or alterations may be made therein by those with ordinary skill in the art without departing from the spirit and scope of the invention as set forth in the appended claims.

I claim:

1. A loud speaker system comprising:

a loud speaker having a moving member for generating acoustic energy;

enclosure means forming, together with the moving member, a substantially air-tight enclosure having a predetermined volume, the enclosure means including at least one edge supported panel comprised of a skin means and stiffening means for stiffening the panel; and said stiffening means providing sufficient stiffness to said skin means to substantially reduce the transmission of longer wave length acoustic energy and providing edge supported sub-panels having a sufficiently small mass per unit area to transmit shorter wave length acoustic energy.

2. The loud speaker system of claim 1 wherein:

the longer wave length acoustic energy are those wave lengths which would tend to distinctively interfere with acoustic energy generated externally of the enclosure means if transmitted through the enclosure means.

3. The loud speaker system of claim 2 wherein:

the shorter wave length acoustic energy is that range of wave lengths which will not distinctively interfere with acoustic energy generated externally of the enclosure means, if such energy were transmitted through the enclosure means, including those frequencies at which a nontransmitting enclosure of the same dimension would resonate.

4. The audio speaker comprising an acoustic transducer having a reciprocating diaphragm for producing audible acoustic energy when reciprocated, and enclosure means for the transducer forming a substantially sealed chamber with the diaphragm, the enclosure means being a substantially rigid structure to low frequency acoustic energy produced within the enclosure by reciprocation of the diaphragm to prevent significant transmission of the low frequency energy through the enclosure means and thereby enhance the generation of low frequency audio energy, yet having at least one section of sufficiently low unit mass to transmit a significant part of the acoustic energy having a frequency corresponding substantially to at least the primary resonant frequency of the enclosure to retard resonation within the enclosure.

5. A speaker system, comprising:

an acoustic transducer; and a plurality of planar panels forming an enclosure with an opening therein, said transducer being attached across said opening to seal said enclosure, at least one of said panels comprising a planar wall, said wall having a mass per unit area which will transmit acoustic energy other than low frequency acoustic energy through said wall, and rib means attached to said wall for edge mounting and stiffening said wall to reduce transmission of low frequency acoustic energy through said wall.

6. A sound reproducing apparatus comprising:

loud speaker means for converting electrical energy into audio acoustic energy; and an enclosure having five square shaped walls, said walls being rigidly attached together at the edges of said walls to form five sides of said enclosure, said speaker being mounted on said remaining edges to complete said enclosure, each of said walls being planar on its exterior facing side and each of the interior facing sides of said walls having a first group of parallel spaced ribs extending across each of said walls and a second group of parallel spaced ribs extending across each of said walls in a direction transverse to said first group, said walls having a sufficiently low mass per unit area to transmit sufficient acoustic energy having frequencies in the resonation range of the enclosure to retard resonation within the enclosure, said ribs of the side walls being interconnected to provide sufficient rigidity to the enclosure to contain a major portion of the acoustic energy having frequencies below the resonation range of the enclosure.

7. A sound reproducing apparatus as defined in claim 6 wherein each of said walls has a 45° bevelled surface at its edges, and said walls are attached together with adjacent bevelled surfaces in contact.

8. A speaker system comprising:

an acoustic transducer; and a plurality of planar panels forming an enclosure with an opening therein, said transducer being attached across said opening to seal said enclosure, at least one of said panels comprising a planar wall having mass per unit area sufficiently low to transmit a sufficient portion of the acoustic energy having frequencies which would otherwise tend to resonate in the enclosure and rib means attached to said planar wall for adding rigidity to said planar wall to contain the acoustic energy having lower frequencies than that which would otherwise tend to resonate in the enclosure.

9. A system as defined in claim 8 wherein said at least one panel is edge supported.

10. The method for retarding resonation in a substantially sealed speaker system which comprises transmitting a sufficiently large portion of the acoustic energy having a wavelength such as to cause resonation through at least one wall of the sealed enclosure to substantially eliminate resonation while preventing deformation of the walls to a sufficient extent to substantially contain acoustic energy having wavelengths greater than that in the resonation range.

* * * * *